United States Patent [19]

Harrison

[11] Patent Number: 4,743,028

[45] Date of Patent: May 10, 1988

[54] GOLF SWING PRACTICE DEVICE

[76] Inventor: Keith Harrison, 585 South Road, Moorabbin, Victoria 3189, Australia

[21] Appl. No.: 802,173

[22] PCT Filed: Mar. 26, 1985

[86] PCT No.: PCT/AU85/00059

§ 371 Date: Jan. 17, 1986

§ 102(e) Date: Jan. 17, 1986

[87] PCT Pub. No.: WO85/04337

PCT Pub. Date: Oct. 10, 1985

[30] Foreign Application Priority Data

Mar. 26, 1984 [AU] Australia ..... PG4246

[51] Int. Cl.[4] ..... A63B 69/36

[52] U.S. Cl. ..... 273/183 B; 273/189 R; 340/573

[58] Field of Search ..... 273/183 B, 189 R, 188 R; 340/573, 574

[56] References Cited

U.S. PATENT DOCUMENTS

| | | | |
|---|---|---|---|
| 2,064,603 | 12/1936 | Harrison | 273/183 B |
| 2,093,153 | 7/1935 | McCarthy | 273/189 R |
| 2,106,658 | 1/1938 | Rakos | 340/574 |
| 2,445,839 | 7/1948 | Newnan et al. | 273/183 B |
| 2,773,691 | 5/1953 | Redfield | 273/189 R |
| 3,243,186 | 3/1966 | Johnson | 273/183 B |
| 3,362,023 | 1/1968 | McMahon | 273/183 B |
| 3,582,935 | 6/1971 | Verhaeghe | 340/573 |
| 3,762,720 | 10/1973 | Jett | 273/183 D |
| 3,767,205 | 10/1973 | Maldonado et al. | 273/190 R |
| 3,861,688 | 1/1975 | Butler | 273/183 B |
| 4,061,340 | 7/1976 | Husted | 273/189 R |
| 4,193,065 | 3/1980 | Bittner | 273/183 B |
| 4,227,189 | 10/1980 | Davis | 340/573 |
| 4,488,726 | 12/1984 | Murray | 273/183 B |

FOREIGN PATENT DOCUMENTS

| | | | |
|---|---|---|---|
| 5287669 | 10/1970 | Australia | 273/183 A |
| 2092283 | 11/1983 | Australia | 273/189 R |

*Primary Examiner*—George J. Marlo

*Attorney, Agent, or Firm*—Sughrue, Mion, Zinn, Macpeak & Seas

[57] ABSTRACT

A training device for golfers includes a main body having a concave side which can be held against the inside of a golfer's power arm by an arm encircling strap. The main body includes two parts biased away from each other and a spring biased switch. When the golfer's power arm is pressed against the golfer's body, the two parts of the housing are compressed and the switch is actuated, so that an indicator such as a buzzer in an electrical circuit can be controlled. The device thus monitors movement of the golfer's power arm away from the body while swinging a golf club.

3 Claims, 2 Drawing Sheets

FIG. 1
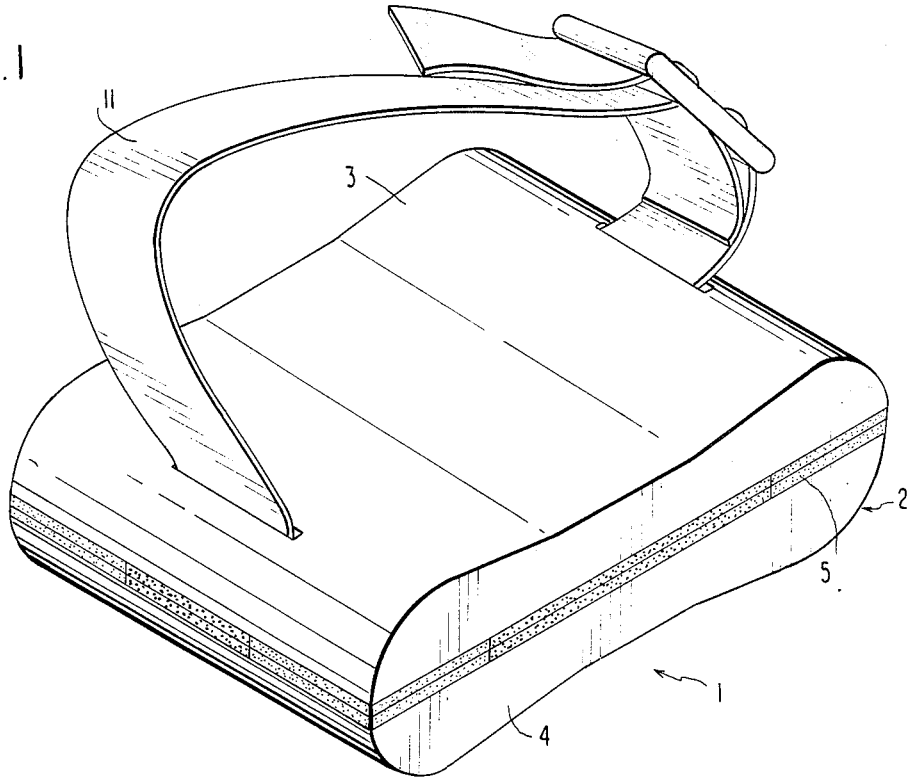
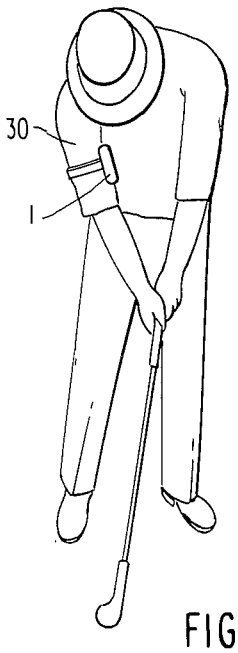
FIG. 2
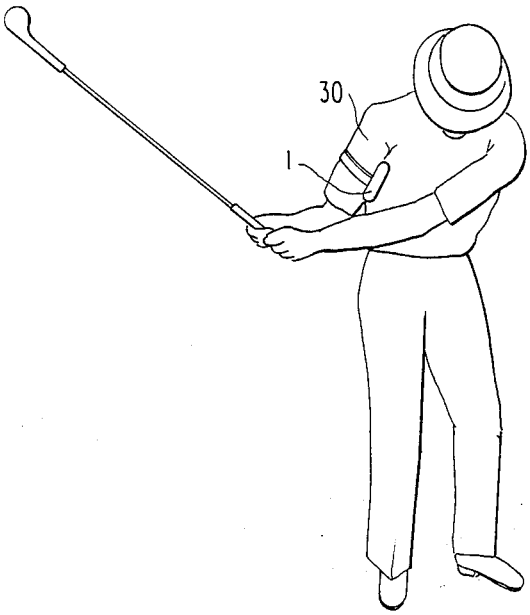
FIG. 3

FIG. 5
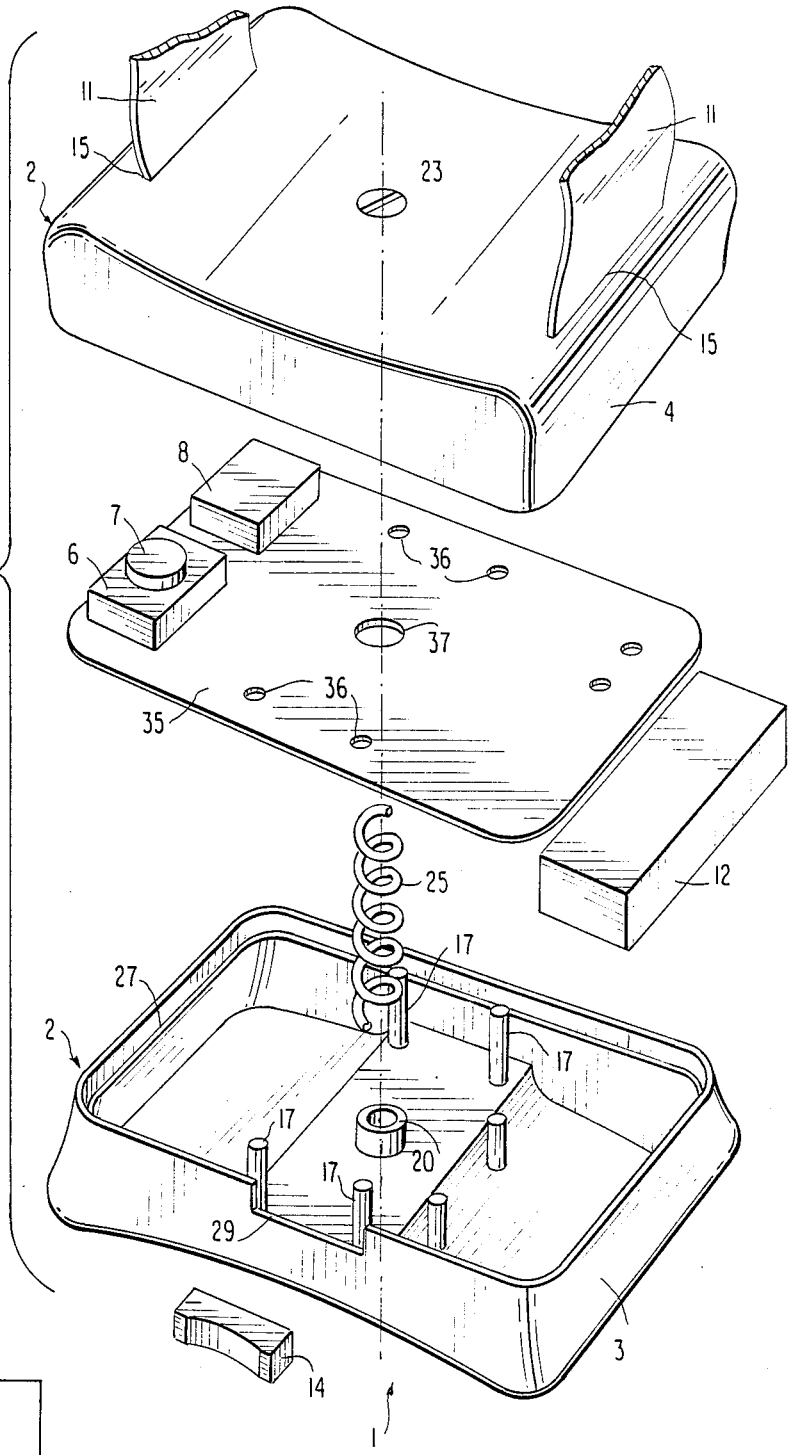
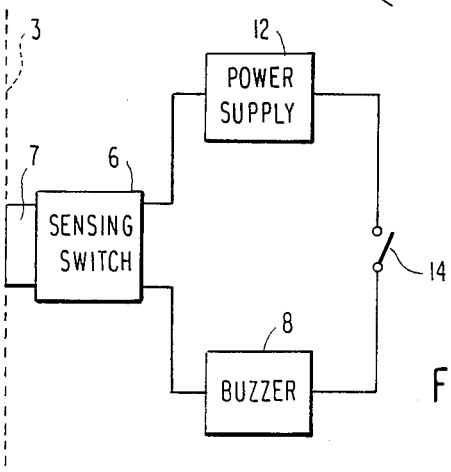
FIG. 4

GOLF SWING PRACTICE DEVICE

The present invention relates to a golf swing practice device.

The correct positioning of the "power arm" with respect to the body of a golfer during a golf swing is an important aspect of the golf swing. The term "power arm" as used herein means the arm which generates club head speed. In particular the power arm is the right arm of the golfer playing with right handed clubs and the left arm of a golfer playing with left handed clubs. A problem common to many golfers is that the upper portion of the power arm moves too far away from the body during the back swinging of the golf stroke. This can result in a loss of power and control of the golf club head. As such, golfers must make a conscious effort to try and learn to keep the upper portion of the power arm tucked in against the body during swinging.

Applicant has already devised a practice device to assist in learning control of the power arm and this device is the subject of Australian co-pending application 20922/83. While this device is satisfactory it does create some difficulties owing to its relatively large size.

U. S. Pat. No. 4,193,065 discloses a device for indicating to a golfer that the golfer's target control arm is being bent during a golf swing. Essentially the device comprises a movable member which is hingedly connected to a main housing both of which are strapped about the golfer's target control arm so that hinged or pivotal movement of the member causes a circuit to open and close thereby illuminating a light if the golfer's control arm bends. While this device may be satisfactory for the specific problem of target arm control it clearly would not be suitable for the problem confronted by applicant in the present invention for reasons which will be apparent from a reading of the following description.

It is a object of the present invention to provide a golf swing practice device which can be used by a golfer to develop a better golf swing.

According to the present invention there is provided a golf swing practice device for providing an indication as to the position of a golfer's power arm with respect to their body during the execution of their golf swing, the practice device comprising:

a main body which is configured so that, in an operative position, it can be disposed between the golfer's power arm and their body and including means for securing the main body in said operative position;

sensing means operatively carried by said main body and being capable of adopting either an activated position or a de-activated position;

biasing means for causing said sensing means to be normally urged into one of said activated or de-activated positions and, in use, said sensing means is adapted to be urged into the other of said positions as a result of pressure applied by the golfer's power arm towards their body against the bias of said biasing means; and indicating means responsive to the position of said sensing means to provide an indication as to which of said positions said sensing means is in, said sensing means and said indicating means being arranged in an electrical circuit.

In use the main body is configured for positioning between the inside of the user's upper portion of the power arm and the user's body and when the arm is in the correct position against the user's body the sensing means adopts either its activated or deactivated position. During the back swing of the golf stroke the sensing means will move into the outer position as a result of the upper portion of the user's power arm moving substantially away from the user's body.

Preferably the main body comprises two parts which are operatively connected together for limited movement towards and away from one another, this limited movement causing the sensing means to adopt its activated and deactivated positions.

The biasing means may be adapted to normally urge the two parts of the main body away from one another. In one form the biasing means may comprise a piece of resilient or elastic material disposed between the two parts of the main body. In another form the biasing means comprises a spring which is disposed within the main body so as to urge the two parts of the main body away from one another.

The sensing means may comprise a spring loaded switch which is mounted within the main body and is arranged so that it is normally urged into the activated position in which position it closes the electrical circuit.

The indicating means may be in the form of an audio indicator such as a buzzer or a visual indicator such as a light which is operated when the sensing means is in the activated position. The electrical circuit may further include an over-ride switch which can render the device operative or inoperative.

Fastening means may be provided for securing the device in position on the user's arm. Such fastening means may be in the form of an elastic strap which can be secured to the bicep of the power arm.

It will be appreciated from the foregoing that the device of the present invention provides a far more compact device than that previously contemplated by applicant in his co-pending Australian patent specification No. 20922/83. It differs from the U.S. Pat. No. 4,193,065 in that not only is it used for an entirely different golf problem but it is also structurally distinguishable. In particular the biasing means enables the sensing means to adopt either its activated or deactivated positions, and in the preferred form where the main body comprises two parts which are arranged for relative limited movement towards and away from each other to activate and deactivate the sensing means, this provides a suitable arrangement by which the position of the power arm relative to the body of the user can be sensed.

Preferred embodiments of the invention will hereinafter be described with reference to the accompanying drawings in which:

FIG. 1 is a perspective view of one form of a golf swing practice device according to the present invention;

FIGS. 2 and 3 are front and side views respectively of a golfer during different stages of a golf swing, the golfer having the practice device of the present invention secured to the upper portion of the power arm;

FIG. 4 is a schematic view showing various component parts of the apparatus in an electric circuit; and FIG. 5 is an exploded perspective view of another form of golf practice device according to the present invention.

Referring to the drawings the golf swing practice device generally indicated at 1 comprises a main body 2 having two parts 3 and 4. The two parts of the main body have contoured side faces so that the body 2 can fit snugly between the user's power arm and body. Fastening means in the form of a strap 11 is provided for securing the main body 2 to the user's arm.

In the embodiment shown in FIG. 1 the biasing means is in the form of a piece of elastic or resilient material 5 which is disposed intermediate the two parts 3 and 4 of the main body 2. In the embodiment shown in FIG. 5 the biasing means is in the form of a spring 25 which is carried on mounting post 20 and a co-operating post (not shown on part 4). The two parts are secured together by means of screw 23 arranged to provide for limited movement between the two parts. A rebate or ridge, 27 on one part and a corresponding portion on the other part provides for correct location of the two parts during their limited movement relative to one another.

In the embodiment shown in FIG. 5 there is also provided locating pillars 17 on one part which are adapted to co-operate with sockets (not shown) on the other part.

The device 1 comprises a sensing switch 6 having a pressure sensitive button 7 located within the housing so that the pressure sensitive button 7 is responsive to relative movement between the parts of the body 2. The sensing switch 6 is in an electrical circuit which as shown in FIG. 5 can be mounted to a circuit board 35. The circuit board is located by means of apertures 36 and 37 co-operating with posts 17 and 20.

The indicating means may be in the form of a buzzer 8 also within the electrical circuit.

The circuit may further include an over-ride switch 14 which is readily accessible through cut-out 29 and a power supply in the form of a battery 12 is also mounted within the main body.

When the device is secured to the user and the user is in the position as shown in FIG. 2 the power arm is pressed firmly against the body and thereby compresses the two parts of the main body 3 and 4 together and as such urges the switch 6 into the deactivated position. The switch 6 will remain in this position unless the user's power arm moves substantially away from the body during the arc of the golf swing. If for example the user in the position shown in FIG. 3 moves the power arm away from the body more than what is shown in FIG. 3 the button 7 of switch 6 would be biased into the activated position whereby the circuit would be completed (provided over-ride switch 14 is closed) thereby actuating the buzzer 8. It will be appreciated that instead of a buzzer a different type of indicator such as a light could be used.

I claim:

1. A golf swing practice device for providing an indication as to the position of a golfer's power arm with respect to a golfer's body during the execution of a golf swing, the practice device comprising:

a main body which is configured so that, in an operative position, it can be disposed between the golfer's power arm and the golfer's body, said main body comprising two parts operatively connected together for limited movement toward and away from one another wherein at least one of said parts has an outer concave surface for contacting the arm;

securing means attached to said main body for securing the practice device to the golfer's power arm;

sensing means comprising a spring loaded switch mounted on said main body between said two parts for movement between a first position and a second position;

biasing means normally biasing said two parts of said main body away from each other whereby said spring loaded switch is allowed to move to one of said positions upon movement of said two parts away from each other and being adapted to be moved to the other of said positions as a result of pressure applied to said parts by a golfer's power arm against the bias of said biasing means; and indicating means responsive to said spring bias switch being in one of said positions to provide an indication as to which of said positions said spring biased switch is in, said switch and said indicating means being arranged in an electrical circuit.

2. A golf swing practice device according to claim 1 wherein said biasing means comprises a piece of resilient, elastic material disposed between said two parts of said main body.

3. A golf swing practice device according to claim 1 wherein said biasing means comprises a spring disposed within said main body.

* * * * *